US005290195A

United States Patent [19]

Prickett

[11] Patent Number: 5,290,195

[45] Date of Patent: Mar. 1, 1994

[54] RELEASABLE ANCHOR PLUG FOR WATERSPORT BOARDS

[76] Inventor: Timothy B. Prickett, c/o 58-304 Kam Hwy., Sunset Beach, Haleiwa, Hi. 96712

[21] Appl. No.: 41,574

[22] Filed: Apr. 5, 1993

Related U.S. Application Data

[63] Continuation-in-part of Ser. No. 779,064, Oct. 17, 1991, Pat. No. 5,199,916.

[51] Int. Cl.[5] ..... B63B 35/79

[52] U.S. Cl. ..... 441/75; 410/111

[58] Field of Search ..... 441/74, 75, 60, 65, 441/68; 114/253, 39.2; 410/80, 110, 111

[56] References Cited

U.S. PATENT DOCUMENTS

| | | | |
|---|---|---|---|
| 2,567,069 | 9/1951 | Harley . | |
| 2,946,305 | 7/1960 | Hill | 114/253 |
| 3,181,861 | 5/1965 | Wilkinson | 272/32 |
| 3,380,425 | 4/1968 | Wilson | 114/253 |
| 3,802,374 | 4/1974 | Brown | 114/253 |
| 3,860,209 | 1/1975 | Strecker | 248/119 R |
| 4,107,806 | 8/1978 | Newland et al. | 441/75 |
| 4,216,567 | 8/1980 | Heinz | 24/81 |
| 4,400,856 | 8/1983 | Tseng . | |
| 4,457,650 | 7/1984 | Tseng | 410/111 |
| 4,528,924 | 7/1985 | Marker et al. | 114/39.2 |
| 4,622,726 | 11/1986 | Nakamura | 24/590 |
| 4,645,392 | 2/1987 | Takaguchi | 410/80 |
| 4,685,237 | 8/1987 | Hugg | 42/85 |
| 4,712,394 | 12/1987 | Bull | 441/74 |
| 4,820,220 | 4/1989 | Fruzzetti et al. | 441/74 |
| 4,938,725 | 7/1990 | Beck | 441/75 |

FOREIGN PATENT DOCUMENTS

| | | | |
|---|---|---|---|
| 3415021 | 10/1984 | Fed. Rep. of Germany | 441/75 |

*Primary Examiner*—Jesus D. Sotelo

*Attorney, Agent, or Firm*—Nixon & Vanderhye

[57] ABSTRACT

An anchor plug with a leash pin is mounted in a surfboard by drilling a hole in the top surface of the board, pouring resin into the hole, inserting the anchor plug so that it is substantially flush with the surfboard surface, causing the resin to harden, and then abrading away the closed top of the anchor plug to expose a cavity with a leash pin within it. The leash pin may be moved between a holding and a release position by pushing down on an actuator and sliding it in an actuator cavity. The anchor plug may be mounted in a Boogie Board by providing a stem with external threading extending from the bottom of the plug, and having it cooperate with a locking element having an internally threaded projection.

25 Claims, 5 Drawing Sheets

FIG. 10
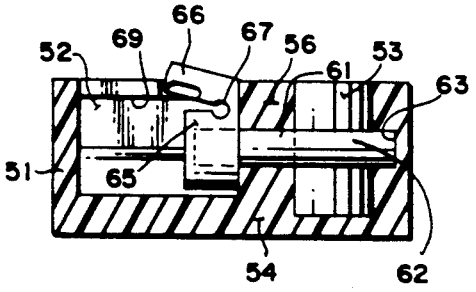
FIG. 11
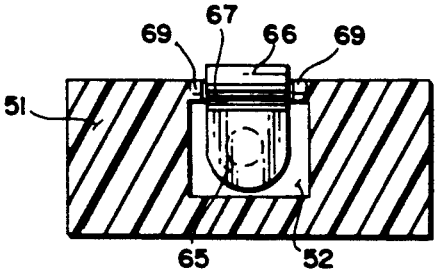
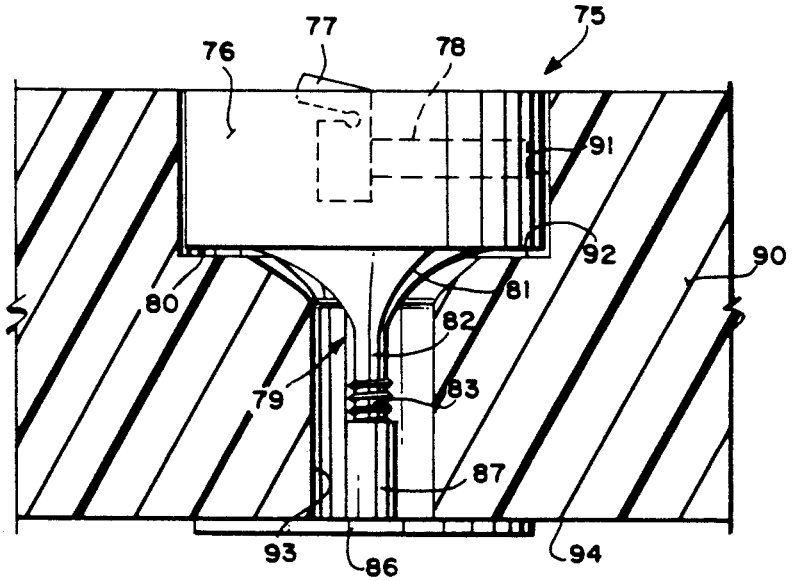
FIG. 12

FIG. 13
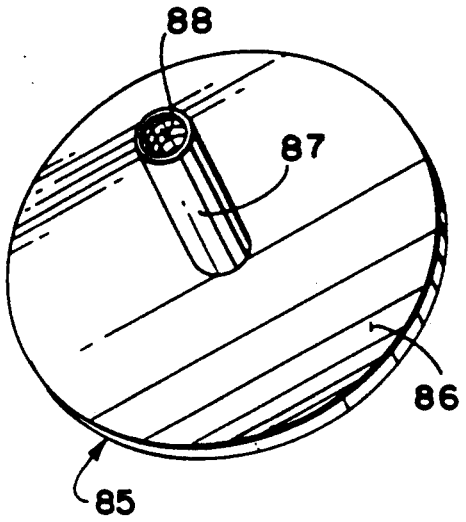
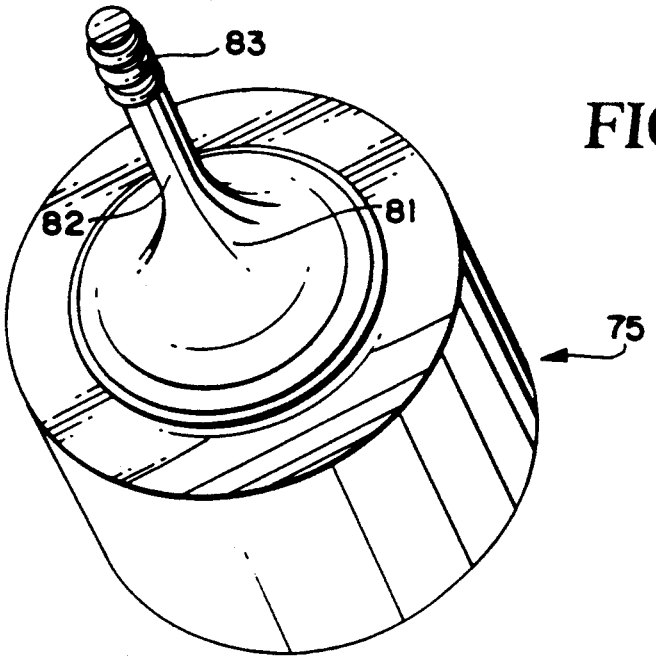
FIG. 14

RELEASABLE ANCHOR PLUG FOR WATERSPORT BOARDS

RELATED APPLICATIONS

This application is a continuation-in-part of U.S. application Ser. No. 07/779,064 filed Oct. 17, 1991, now U.S. Pat. No. 5,199,916.

FIELD OF THE INVENTION

This invention relates to a releasable anchor plug for easily detaching and attaching a leash to an object such as a surfboard or a boat.

Surfers usually tie their surfboards to their ankles by a leash that is detachably fastened to the surfboard. It would be dangerous to provide any type of fastening device to the surfboard end of the leash because the surfer could be injured if the fastening device became detached during use. Thus, any device for detachably fastening a leash to a surfboard must not require attaching anything to the end of the leash.

It would be preferable for any type of fastening device to be flush with the surface of the surfboard so that the surfer will not be injured by any projections upon impact with the surfboard and to avoid altering the hydrodynamic characteristics of the surfboard.

Surfboards now are usually provided with an anchor plug having a cavity and a fixed leash pin spanning the cavity. The anchor plug is usually recessed into the surfboard, flush with the top surface. The surfer's leash is usually tied around the fixed leash pin. This construction provides assurance that the leash will not become detached regardless of the direction in which it is pulled during surfing, unless the leash becomes untied. If the leash becomes untied, the surfer would only be hit by the leash. However, this construction is inconvenient because the leash must be tied and untied in order to attach and detach it to the surfboard's anchor plug.

BACKGROUND AND SUMMARY OF THE INVENTION

U.S. Pat. No. 4,712,394 to Bull discloses an arrangement for providing a secure tie point using a lock to protect a surfboard from being stolen, by threading a cable or chain through the surfboard, attaching it around a solid object and locking it, similar to locking a bicycle.

U.S. Pat. No. 3,802,374 to Brown discloses a cylindrical body attached to a surfboard with a frictionally engageable shaft having an eyelet for towing the surfboard behind a boat.

U.S. Pat. No. 3,380,425 to Wilson discloses various arrangements for attaching a towing line to a surfboard, including a cam chock in FIG. 6 and a capstan and loop connection in FIG. 8. However, these types of connections might become detached if the towing line is pulled in certain directions.

None of these references provides a detachable fastening means that does not require attaching a device to the end of the leash, that would not become detached regardless of the direction in which the leash is pulled, and that can be mounted flush with the surface of a surfboard. Thus, there has long been a need for an anchor plug on a surfboard that allows easy attachment and detachment of a leash, without requiring tying or untying the leash to the surfboard, and yet retains the advantages of the anchor plugs currently being used.

It is therefore an object of this invention to provide a means for quickly and easily attaching and detaching a leash to a surfboard, rather than tying or untying the leash from an anchor plug with a stationary pin.

It is a still further object of this invention to provide such a means that is comparable in strength and reliability to an anchor plug using a stationary pin. It is a still further object of this invention to provide such a means that can be retrofitted to replace existing anchors.

It is a still further object to provide such a means that can be mounted flush with a surface.

It is a further object of the present invention to readily mount an anchor plug in a surfboard, or other waterboard of relatively hard material, in a manner that is simple and effective, yet will not destroy the operability of the moveable leash pin.

It is also an object of the present invention to be able to provide a releasable anchor plug in waterboards that are of relatively soft material, like Boogie Boards, in addition to surfboards and windsurfing boards, by connecting opposed portions of an anchor plug assembly extending from different surfaces of the board together.

These and other objects are achieved by a releasable anchor plug, comprising a housing having a leash cavity with a retractable leash pin spanning the leash cavity when the pin is in its extended position. Preferably, a locking means (such as a sliding snap with a lip that engages in a groove) for locking the leash pin in the extended position is provided. Preferably also, a locking hole for receiving the end of the leash pin is provided in the housing so that the leash pin extends into the locking hole when it is in the extended position, thereby supporting the leash pin on both sides of the leash cavity when it is in the extended position. A cover plate having spring fingers is preferably inserted into the cavity for the snap, with the cover plate covering the cavity and the spring fingers supporting the snap to retain the lip of the snap in the groove when locked. Preferably also, the housing has the same configuration as anchor plugs currently being used so that it can be retrofitted to existing surfboards.

To use the invention, a loop is formed in the leash and the leash is fastened simply by retracting the pin, passing the loop over the end of the retracted pin and into the leash cavity, and then extending the pin until it is received in the locking hole, thereby spanning the leash cavity and retaining the loop, thus ensuring positive and reliable attachment of the leash to the surfboard. To detach the leash, the leash pin is retracted to prevent the leash pin from spanning the leash cavity, thereby creating a space between the end of the leash pin and the housing; the loop is passed through this space.

The top of the anchor plug is preferably mounted flush to the deck of the surfboard, by drilling a hole slightly larger in diameter than the anchor plug itself and deep enough to accept the anchor plug, then cementing the plug to the surfboard with polyester resin.

The retractable leash pin preferably comprises stainless steel and is preferably attached to a snap that is mounted to slide between open and closed positions. Preferably also, locking means is provided to lock the snap (and therefore the leash pin) in he extended position to span the leash cavity. The relatively open design of the invention also allows easy cleaning by flushing with water.

According to one aspect of the present invention, a method of mounting an anchor plug for a leash within a waterboard having a first surface, the anchor plug having a cavity with a leash pin accessible therein, and a closed top covering the cavity, is provided. The method comprises the following steps: (a) Providing a hole in said waterboard, open to the first surface of the waterboard. (b) Supplying fluid but hardenable mounting material (e. g. resin) into the hole. (c) Inserting the anchor plug into the hole in contact with the fluid mounting material so that the closed top thereof is substantially flush with the first surface of the waterboard. (d) Causing the fluid mounting material to harden to positively hold the anchor plug in place in the hole. And (e) removing the closed top of the anchor plug to expose the cavity with leash pin accessible therein.

Step (e) is preferably practiced by abrading (e.g. grinding or sanding) or cutting the closed top off the anchor plug. There is also preferably the further step (f), between steps (c) and (d), of positively holding the anchor plug in place until the resin hardens; and step (f) is typically practiced by placing a piece of tape with pressure sensitive adhesive over the anchor plug, engaging both the anchor plug and the first surface of the waterboard until the mounting material hardens.

The anchor plug normally has depth guide projections thereon, and if so, step (c) is practiced so as to insert the anchor plug only up to the depth guide projections thereon, i.e. so that they are flush with the first surface of the surfboard. The anchor plug also typically has a pin simulating projection extending upwardly from the closed top thereof extending in alignment with the leash pin within the anchor plug, and then step (c) is practiced so as to align the pin simulating projection so that it has the same orientation as desired for the leash pin within the anchor plug.

According to another aspect of the present invention, an anchor plug for effective and simple installation into surfboards and the like is provided. The anchor plug comprises the following elements: A substantially cylindrical body element having a closed top, bottom, and sidewall. First and second cavities within said body, separated by an interior wall. A leash pin mounted for slidable movement in and with respect to the cavities, through an opening in the interior wall. An actuator mounted within the first cavity for effecting slidable movement of the leash pin. A recess in the second cavity for receiving the leash pin in a leash holding position. And an opening to each of the first and second cavities just below said closed top of the body element, allowing access to the actuator and to the leash pin within the second cavity.

The plug according to the invention also preferably further comprises indicating means on the top of the closed top of said body element, indicating the orientation of the leash pin within the body element. The indicating means typically comprises a protrusion having a simulated pin shape, and an orientation the same as the leash pin. The body is typically of hard plastic, and the closed top is integral with the sidewall and bottom, and can be removed only by cutting or grinding it away.

The invention also contemplate an anchor plug wherein the actuator includes a human-finger engageable element biased to a position extending through the top opening to the first cavity when the closed top is removed. The actuator preferably is of plastic material and includes a living hinge.

The invention also contemplates a waterboard having the following elements: A body having opposite first and second surfaces, and an anchor-plug receiving through-extending opening formed in the body, and extending between the first and second surfaces. An anchor plug disposed within the through-extending opening, the anchor plug comprising: a body element having a closed bottom and sidewall; first and second cavities within said body, separated by an interior wall; a leash pin mounted for slidable movement in and with respect to the cavities, through an opening in the interior wall; an actuator mounted within the first cavity for effecting slidable movement of the leash pin; a recess in the second cavity for receiving the leash pin in a leash holding position; a top opening to each of the first and second cavities allowing access to the actuator and to the leash pin within the second cavity from the waterboard body first surface; and a stem extending downwardly from the body bottom, the stem having surface manifestations. And a locking element, the locking element including a substantially planar portion, and projecting means having surface manifestations complementary to the surface manifestations on the stem. The locking element projecting means extends into the through extending opening from the waterboard second surface, and the surface manifestations on the locking element and anchor plug engage to hold the anchor plug securely within the waterboard opening even if a force is exerted thereon by a leash.

Preferably, the surface manifestations comprise external threading on the stem, and internal threading within the projecting means, or like elements that will not detach easily, such as a linear ratchet arrangement, elongated projection and groove, press fit surfaces, or the like. The substantially planar portion may comprise a disc, and the locking element and anchor plug are preferably substantially flush with the first and second surfaces, not projecting any substantial distance thereabove.

BRIEF DESCRIPTION OF THE DRAWINGS

FIG. 10 is a view like that of FIG. 8 only after the closed top has been ground away, and with the leash pin bridging the leash cavity to lock a leash within it;

FIG. 11 is an end view, partly in cross-section and partly in elevation, of the plug of FIGS. 9 and 10;

FIG. 12 is a side view showing still another embodiment of anchor plug according to the invention in association with a Boogie Board, the board shown in cross-section, and the plug and associated locking component in elevation;

FIG. 13 is a top perspective view of the locking component of FIG. 12; and

FIG. 14 is a bottom perspective view of the plug of FIG. 12.

DETAILED DESCRIPTION OF THE DRAWINGS

Figure 1:
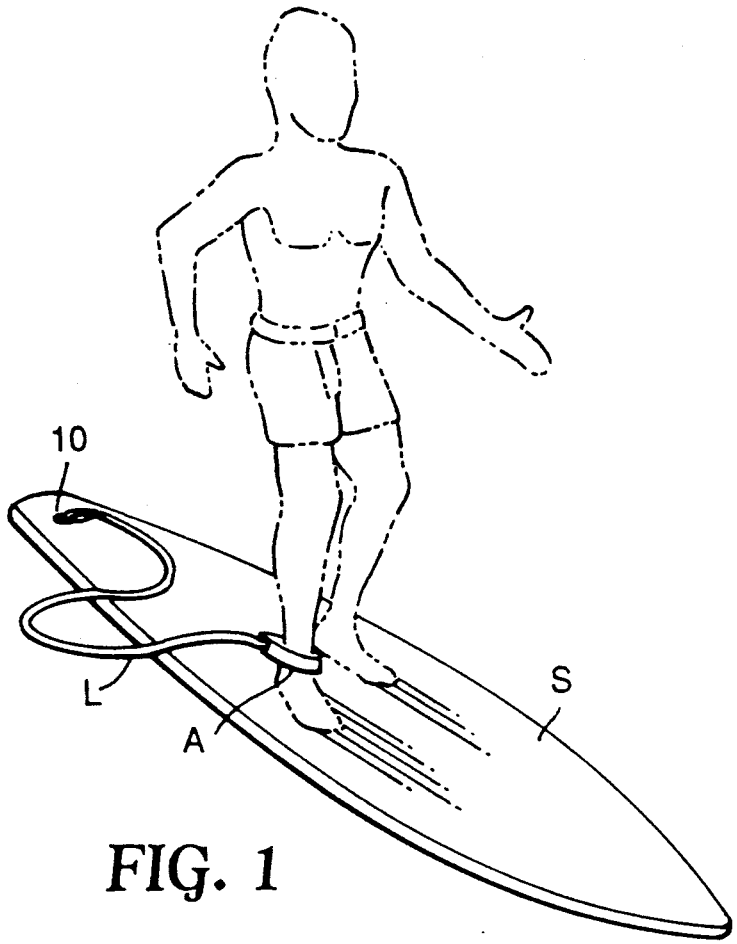
FIG. 1 is a perspective view generally showing a preferred embodiment of the invention when installed and used on a surfboard.

Referring to FIG. 1, generally shown is installation of the anchor plug 10 on a surfboard S. The surfer's leash L connects the anchor plug 10 to the surfer's ankle A.

Figure 2:
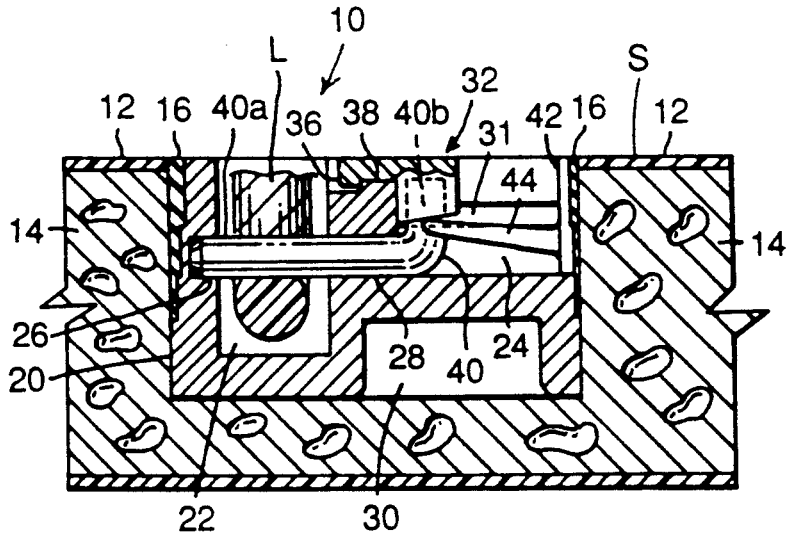
FIG. 2 is a sectional view of the embodiment of FIG. 1 as installed in a surfboard showing the surrounding environment.
Figure 3:
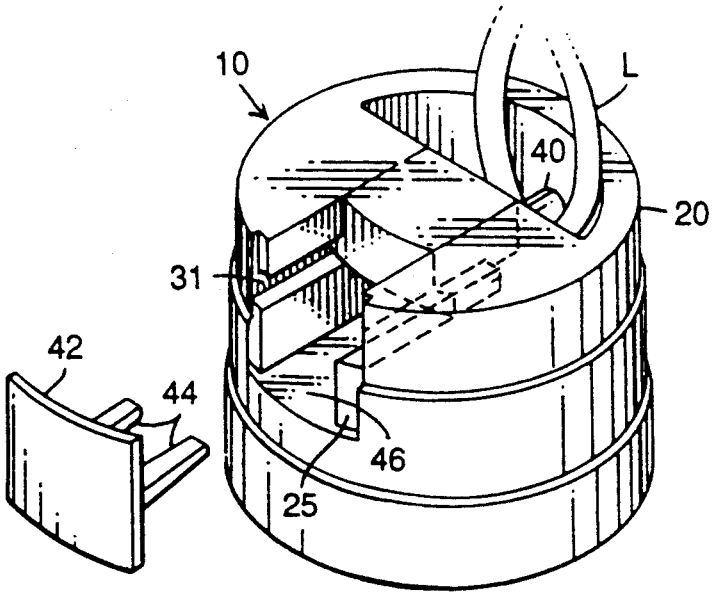
FIG. 3 is a perspective exploded view of the embodiment of FIG. 2.
Figure 4:
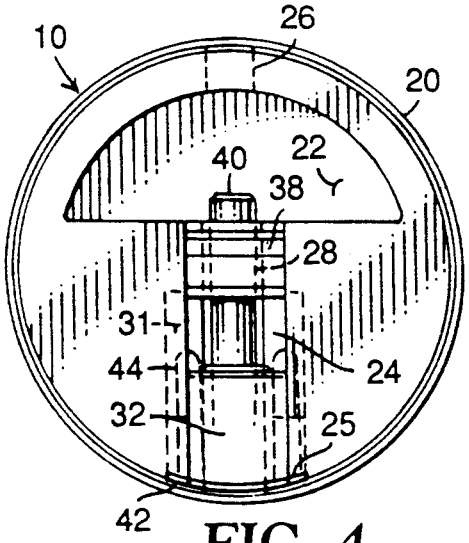
FIG. 4 is a top plan view of the embodiment of FIG. 2 showing the leash pin in the retracted position.
Figure 5:
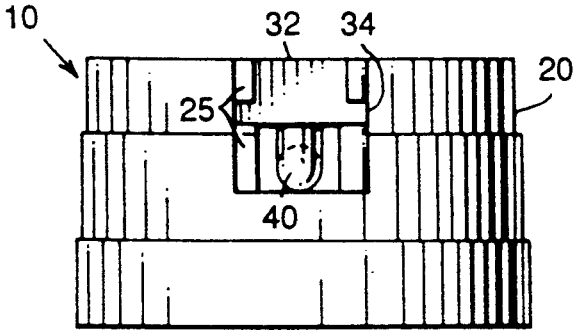
FIG. 5 is a front elevational view of the embodiment of FIG. 2 with the cover plate removed.
Figure 6:
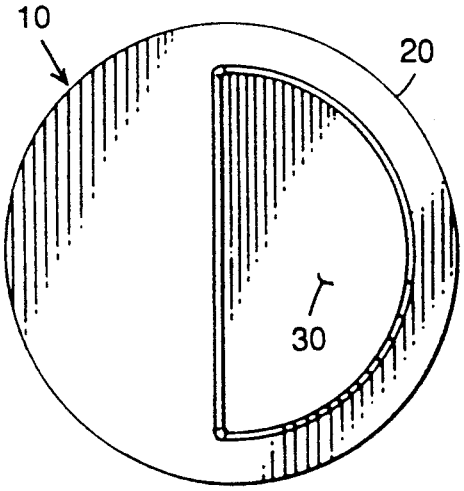
FIG. 6 is a bottom plan view of the embodiment of FIG. 2 showing the leash cavity.

Referring to FIG. 2, shown is a cross section of the anchor plug 10 installed in the surfboard S. The anchor plug 10 is preferably installed by drilling a hole slightly larger than the anchor plug 10 into the top surface of the surfboard S, through the top layer of fiberglass 12 and into the foam 14 in the inner core of the surfboard. The anchor plug 10 would preferably be inserted in the hole and cemented permanently in place by pouring polyester resin 16 between the anchor plug 10 and the foam 14. The top surface of the anchor plug 10 preferably would be sanded flush to the top surface of the surfboard S.

Referring to FIGS. 2 to 6, the anchor plug 10 preferably comprises a plastic housing 20 having an outer cylindrical configuration comprising a plurality (preferably three) of cylinders of graduated diameters, creating a ridged shape for better retention by the polyester resin 16. The housing 20 preferably is provided with a leash cavity 22, a snap cavity 24, and a cover plate recess 25, as well as a locking hole 26, a center hole 28 and a bottom core cavity 30. Two snap channels 31 are preferably formed in the sides of the snap cavity 24. The leash cavity 22 provides a space to accept the leash L for attachment. The snap cavity 24 provides a space for a snap 32 to slide between the extended and retracted positions when extending and retracting a leash pin 40. The locking hole 26 accepts the end of the leash pin 40 when it is extended so that the leash pin 40 is supported on both sides of the leash cavity 22 when it is extended. The center hole 28 allows the leash pin 40 to pass into the leash cavity 22, provides support for the leash pin 22 on one side of the leash cavity 22 and guides the leash pin 40 to be received in the locking hole 26 when the leash pin 40 is extended. The bottom core cavity 30 has no functional purpose except to reduce the amount of material necessary to make the housing. The snap channels 31 guide the snap 32 between the extended and retracted positions.

The snap 32 preferably has two flanges 34 conforming to the snap channels 31 on the sides and is preferably slidably mounted by inserting the flanges 34 into the snap channels 31. The snap 32 is preferably provided with a lip 36 that locks into a groove 38 in the housing 10 when the snap 32 is slid towards the leash cavity 22. An L shaped leash pin 40 is inserted through the center hole 28 so the long portion 40*a* can slide across the leash cavity 22 and into the locking hole 26, thus spanning the leash cavity 22. The short portion 40*b* is preferably mounted in the snap 32. The leash pin 40 is preferably made of stainless steel.

Preferably a plastic cover plate 42 configured to fit into the cover plate recess 25 and having inwardly projecting cantilevered spring fingers 44 (preferably integrally formed with the cover plate 42) is provided to close off the snap cavity 24 along the circumference of the housing 20. This helps prevent leakage of the resin 16 into the housing 20. The spring fingers 44 preferably project into finger channel 46 and retain the snap 32 in position so that the lip 36 remains locked into the groove 38 when the snap is in the engaged position. This helps to prevent accidental disengagement of the lip 36 from the groove 38 by rocking of the snap 32.

In use, the long portion 40*a* of the leash pin 40 slides between extended and retracted positions by sliding the snap 32 towards and away from the leash cavity 22. The long portion 40*a* can be locked in the extended position by sliding the lip 36 of the snap 32 until it locks into the groove 38. When locked into the extended position, the long portion of the leash pin 40*a* spans the leash cavity 22 and secures the leash L as securely as if the leash pin were stationery. Yet, the long portion of the leash pin 40*a* also can be retracted easily by disengaging the lip 36 of the snap 32 from the groove 38 and sliding the snap 32 away from the leash cavity 22, so that the leash L can be easily detached merely by passing the loop in the leash L between the housing 20 and the end of the long portion 40*a* of the leash pin 40.

Figure 7:
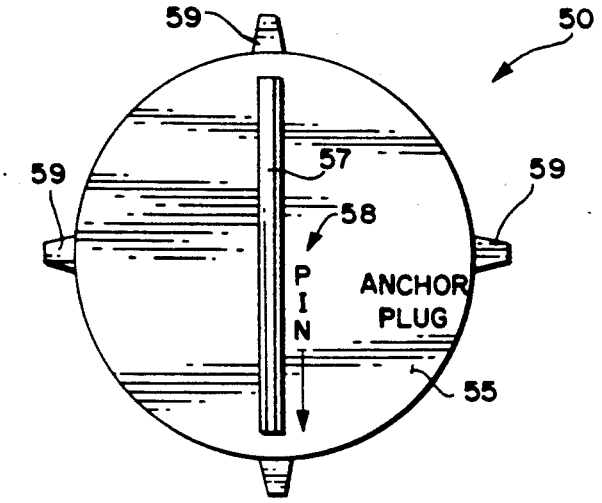
FIG. 7 is a top plan view of another exemplary embodiment of anchor plug according to the present invention.
Figure 8:
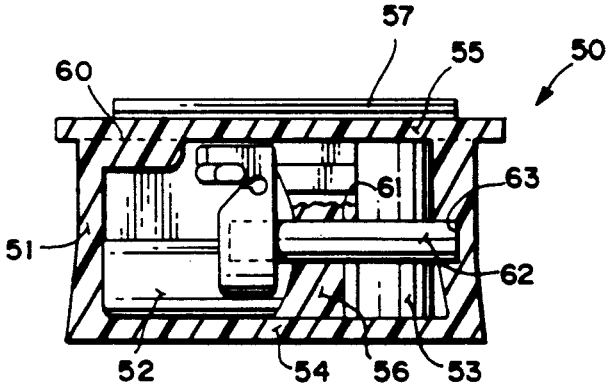
FIG. 8 is a side view of the plug of FIG. 7, partly in cross-section, and partly in elevation.

FIGS. 7 and 8 illustrate a modified form of anchor plug according to the present invention, shown generally by reference numeral 50, which may be easily mounted in a surfboard or other hard waterboard, or hard surface, without the possibility of the reciprocal, slidable action of the leash pin being adversely affected by the mounting procedure. The plug 50 has a substantially cylindrical body element 51 with first and second cavities 52, 53 therein, the cavity 52 being an actuator cavity, and the cavity 53 a leash-receiving cavity. The body element 51 is typically molded of hard plastic, and has a closed bottom 54, and a closed top 55 which is preferably integral therewith. An interior wall 56 separates the cavities 52, 53.

On the exterior (top) of the closed top 55 are indicating means indicating the orientation of the leash pin (62) within the body 51. As seen in FIGS. 7 and 8, the indicating means may take the form of a pin simulating projection 57, having the same alignment and orientation as the leash pin. Instead of, or in addition to, the projection 57, word or symbol indicia 58 may be provided. The body 51 also preferably has depth guide elements 59.

In a typical use of the plug 50, a hole is drilled in the top surface of a surfboard or the like, e. g. a 1 ⅜ inch hole about ⅜ inch deep, i. e. larger than the plug 50. Fluid but hardenable mounting material, such as resin, is poured into the hole, and then the plug 50 inserted, with the top 55 up, until the guides 59 are flush (touch) the top surface of the surfboard. Then the projection 57 is grasped, and manipulated to properly position the leash pin within the plug 50 with respect to the top surface of the surfboard (i. e. so that the projection 57 extends in the orientation desired for the leash pin), and then the plug 50 is positively held in place within the hole, e. g. by placing a piece of adhesive tape (e. g. masking tape) so that the adhesive surface thereof engages both the top 55 and the top surface of the surfboard. After the resin hardens, the tape is removed, and the closed top 55 is removed down to the line 60 in FIG. 8, i. e. to open the tops of both cavities 52, 53. Removal of the top 55 is typically accomplished by abrading it away (e.g. grinding or sanding), or cutting it away.

Figure 9:
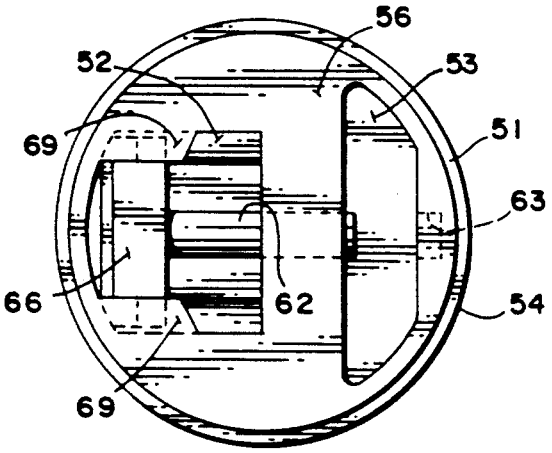
FIG. 9 is a top plan view of the plug of FIG. 7 after the closed top has been ground away, providing access to the leash pin actuator and leash cavity, with the leash pin retracted from the leash cavity.

Within the interior wall 56 is a through extending opening 61 (see FIG. 10), between cavities 52, 53. The opening 61 has an internal diameter or dimensions just slightly larger than the external diameter or dimensions of the leash pin 62 so that it guides sliding of the pin 62 between the positions in FIG. 9 and FIG. 10. In its position (FIG. 10) holding a leash which is within the leash cavity 53 in place, the pin 62 engages the recess 63, while when the pin 62 is retracted (FIG. 9) to allow release of the leash, it does not.

The pin 62 has an actuator for moving it between the cavities 52, 53, guided by the opening 61. The actuator includes the body 65 and finger-engagable element 66, connected together by a living hinge 67 (the elements 65, 66, 67 for example comprising an integral piece of plastic). The hinge 67 normally biases the element 66 upwardly out of the open top of the cavity 52, so that when the pin 62 is in the locking position (FIG. 10) the element 66 must be depressed—to move it out of the way of latch surface manifestations 69 (FIGS. 9 and 10)—into the cavity 52 before it, and the connected leash pin 62, can be moved.

FIGS. 12–14 illustrate another embodiment of anchor plug according to the present invention, in association with a locking element. The assembly of FIGS. 12–14 is most suited for use with a Boogie Board, or other board of other relatively soft material which is not amenable to the installation method described above, however it can also be used with a surfboard or other hard board if desired.

The anchor plug 75 (FIGS. 12 and 14) is just like the plug 50 except that it never has a closed top. It has a substantially cylindrical body 76, and an actuator element 77 is normally biased through the open top of the actuator cavity thereof. The leash pin 78 (shown in dotted line in FIG. 12) corresponds to the pin 62. The body 76 has a substantially closed bottom 80, with a stem 79 extending substantially straight downwardly therefrom. The stem 79 may be integral with the bottom 80 (e. g. molded of the same plastic), and includes a conical base 81, a shaft 82, and surface manifestations 83 (e. g. external threading) on the shaft 82.

The anchor plug 75 is adapted to cooperate with the locking element 85 (FIGS. 12 and 13) to hold it in place in a Boogie board or the like. The locking element 85 preferably includes a substantially planar portion (e. g. disc) 86, with a projection 87 extending upwardly therefrom. The projection 87 has surface manifestations 88 (e. g. internal threading) complementary to the surface manifestations 83, so that they cooperate to hold the elements 75, 85 together, stationary within a Boogie Board 90. The element 85 may be of injection molded plastic, or the like.

Instead of threading 83, 88, the elements 75, 85 may have a linear ratchet arrangement, press fit, elongated projection and groove, or like structures for removably or permanently holding elements 75, 85 together.

The Boogie Board 90 preferably has a large diameter bore 91 extending from the top surface thereof, and a shoulder 92, located from the top surface of the Board 90 a distance corresponding to the height of the plug body 76. The shoulder 92 engages the bottom 80 of the plug 75. Preferably there is a tight fit between the body 76 and Board 90 at the bore 91. The disc 86 engages the bottom of the Board 90 (or is recessed therein). The stem 82 and projection 87 interconnect within the smaller diameter bore 93 extending from shoulder 92 to the bottom of the Board 90.

The invention has been described with respect to a particular preferred embodiment. It will be obvious to those skilled in the art that changes and modifications can be made to the embodiment described above without departing from the spirit and scope of the invention. For example, the leash pin can be biased in the engaged position by a spring or other equivalent means, or can be locked into the extended position with some other type of lock. For a further example, the snap can be slidably mounted using some means other than flanges projecting into channels in the housing. Of course, the housing, leash pin and snap can be made of other materials and, although not preferred, a separate snap can be eliminated by providing a separate locking aperture in the housing adapted to receive and lock the short portion of the leash pin. Accordingly, no limitations are to be implied or inferred in the scope of the invention except as specifically and explicitly set forth in the attached claims.

Industrial Applicability

This invention can be used wherever an object needs to be detachably attached to a leash or other cord-like material regardless of the direction in which the leash might be pulled, and where the anchor must remain flush with a surface of the object. Thus, it can be used in various marine applications, such as in securing water boards and boats, but can also be used in non-marine applications.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

WHAT IS CLAIMED IS:

1. An anchor plug comprising:

a substantially cylindrical body element having a closed top, bottom, and sidewall;

first and second cavities within said body, separated by an interior wall;

a leash pin mounted for slidable movement in and with respect to said cavities, through an opening in said interior wall;

an actuator mounted within said first cavity for effecting slidable movement of said leash pin;

a recess in said second cavity for receiving said leash pin in a leash holding position; and an opening to each of said first and second cavities just below said closed top of said body element, allowing access to said actuator and to said leash pin within said second cavity.

2. A plug as recited in claim 1 further comprising indicating means on the top of said closed top of said body element, indicating the orientation of said leash pin within said body.

3. A plug as recited in claim 2 wherein said indicating means comprises a protrusion having a simulated pin shape, and an orientation the same as said leash pin.

4. A plug as recited in claim 3 wherein said body is of hard plastic, and wherein said closed top is integral with said sidewall and bottom, and can be removed only by cutting or abrading it away.

5. A plug as recited in claim 1 wherein said actuator includes a human-finger engagable element biased to a position extending through said opening to said first cavity when said closed top is removed.

6. A plug as recited in claim 5 wherein said actuator is of plastic material and includes a living hinge.

7. An anchor plug comprising:

a body element having a closed bottom and sidewall;

first and second cavities within said body, separated by an interior wall;

a leash pin mounted for slidable movement in and with respect to said cavities, through an opening in said interior wall;

an actuator mounted within said first cavity for effecting slidable movement of said leash pin;

a recess in said second cavity for receiving said leash pin in a leash holding position;

a top opening to each of said first and second cavities allowing access to said actuator and to said leash pin within said second cavity; and wherein said actuator includes a human-finger engagable element biased to a position extending through said top opening to said first cavity.

8. A plug as recited in claim 7 wherein said actuator is of plastic material and includes a living hinge.

9. A plug as recited in claim 7 further comprising a stem extending downwardly from said body bottom, said stem having surface manifestations for connection to another element for holding said body element in place within a larger body.

10. A plug as recited in claim 9 wherein said surface manifestations comprise external screw threading.

11. A plug as recited in claim 9 in combination with a locking element, said locking element including a substantially planar portion, and projecting means having surface manifestations complementary to the surface manifestations on said stem.

12. A plug as recited in claim 10 in combination with a locking element, said locking element including a substantially planar portion, and projecting means having internal screw threading complementary to the external screw threading on said stem.

13. A waterboard comprising:

a body having opposite first and second surfaces, and an anchor-plug receiving through-extending opening formed in said body, and extending between said first and second surfaces;

an anchor plug disposed within said through-extending opening, said anchor plug comprising: a body element having a closed bottom and sidewall; first and second cavities within said body, separated by an interior wall; a leash pin mounted for slidable movement in and with respect to said cavities, through an opening in said interior wall; an actuator mounted within said first cavity for effecting slidable movement of said leash pin; a recess in said second cavity for receiving said leash pin in a leash holding position; a top opening to each of said first and second cavities allowing access to said actuator and to said leash pin within said second cavity from said waterboard body first surface; and a stem extending downwardly from said body bottom, said stem having surface manifestations; and a locking element, said locking element including a substantially planar portion, and projecting means having surface manifestations complementary to the surface manifestations on said stem;

said locking element projecting means extending into said through extending opening from said waterboard second surface, the surface manifestations on said locking element and anchor plug engaging to hold said anchor plug securely within said waterboard opening even if a force is exerted thereon by a leash.

14. A waterboard as recited in claim 13 wherein said surface manifestations comprise external threading on said stem, and internal threading within said projecting means.

15. A waterboard as recited in claim 13 wherein said wherein said substantially planar portion comprises a disc.

16. A waterboard as recited in claim 13 wherein said locking element and anchor plug are substantially flush with said first and second surfaces, not projecting any substantial distance thereabove.

17. A waterboard as recited in claim 13 wherein said actuator includes a human-finger engagable element biased to a position extending through said top opening to said first cavity.

18. A waterboard as recited in claim 17 wherein said actuator is of plastic material and includes a living hinge.

19. A method of mounting an anchor plug for a leash within a waterboard having a first surface, the anchor plug having a cavity with a leash pin accessible therein, and a closed top covering the cavity, said method comprising the steps of:

(a) providing a hole in the waterboard, open to the first surface of the waterboard;

(b) supplying fluid but hardenable mounting material into the hole;

(c) inserting the anchor plug into the hole in contact with the fluid mounting material so that the closed top thereof is substantially flush with the first surface of the waterboard;

(d) causing the fluid mounting material to harden to positively hold the anchor plug in place in the hole; and (e) removing the closed top of the anchor plug to expose the cavity with leash pin accessible therein.

20. A method as recited in claim 19 wherein step (e) is practiced by abrading or cutting the closed top off the anchor plug.

21. A method as recited in claim 19 comprising the further step (f), between steps (c) and (d), of positively holding the anchor plug in place until the mounting material hardens.

22. A method as recited in claim 21 wherein step (f) is practiced by placing a piece of tape with pressure sensitive adhesive over the anchor plug, engaging both the anchor plug and the first surface of the waterboard, until the mounting material hardens.

23. A method as recited in claim 19 wherein the anchor plug has depth guide projections thereon, and wherein step (c) is practiced so as to insert the anchor plug only up to the depth guide projections thereon.

24. A method as recited in claim 23 wherein the anchor plug has a pin simulating projection extending upwardly from the closed top thereof extending in alignment with the leash pin within the anchor plug, and wherein step (c) is practiced so as to align the pin simulating projection so that it has the same orientation as desired for the leash pin within the anchor plug.

25. A method as recited in claim 19 wherein the anchor plug has a pin simulating projection extending upwardly from the closed top thereof extending in alignment with the leash pin within the anchor plug, and wherein step (c) is practiced to grasp and move the pin simulating projection so as to align the pin simulating projection so that it has the same orientation as desired for the leash pin within the anchor plug.

* * * * *